United States Patent [19]

Whalen

[11] 4,179,954

[45] Dec. 25, 1979

[54] JAR AND BOTTLE OPENER

[76] Inventor: Robert Whalen, 47-57 44th St., Woodside, N.Y. 11377

[21] Appl. No.: 897,556

[22] Filed: Apr. 18, 1978

[51] Int. Cl.[2] ..... B67B 7/00

[52] U.S. Cl. ..... 81/3.44; 81/428 R

[58] Field of Search ..... 81/3.1 R, 3.1 B, 3.34, 81/3.36, 3.4, 3.43, 3.44, 3.46 R, 64, 428 R; 294/97, 106, 117

[56] References Cited

U.S. PATENT DOCUMENTS

| | | | |
|---|---|---|---|
| 218,835 | 8/1879 | Sherwood et al. | 81/3.4 |
| 1,218,576 | 3/1917 | Norwood | 81/428 R |
| 1,976,623 | 10/1934 | Monroe et al. | 81/3.4 |
| 2,001,346 | 5/1935 | Hays | 81/3.44 X |

*Primary Examiner*—James G. Smith
*Attorney, Agent, or Firm*—Daniel Jay Tick

[57] ABSTRACT

A pair of symmetrical elongated gripping members are affixed to each other in angular relation by a generally V-shaped resilient joining member. Each of the gripping members has a length-extending edge with a plurality of spaced partially circular notches formed therein. The notches have diameters varying from a minimum in the area of the joining member to a maximum in the area of the free ends. Handles extend from the free ends of the gripping members to facilitate urging such free ends toward each other to grasp a lid of a container between corresponding notches of the gripping members.

1 Claim, 3 Drawing Figures

JAR AND BOTTLE OPENER

BACKGROUND OF THE INVENTION

The present invention relates to a jar and bottle opener.

Jar and bottle openers similar to that disclosed herein are described in the following United States patents. U.S. Pat. No. 803,034, issued Oct. 31, 1905 to Trickey, U.S. Pat. No. 1,466,118, issued Aug. 28, 1923 to Ciha, U.S. Pat. No. 1,544,961, issued July 7, 1925 to Weil, U.S. Pat. No. 2,001,346, issued May 14, 1935 to Hays, U.S. Pat. No. 2,386,460, issued Oct. 9, 1945 to Heim and U.S. Pat. No. 3,389,622, issued July 25, 1968 to Flugel.

Objects of the invention are to provide a jar and bottle opener of simple structure, which is inexpensive in manufacture, used with facility, convenience and safety, and functions efficiently, effectively and reliably to open a jar, bottle, or other type of container having a cap of any diameter thereon, with a minimum of effort.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

Figure 1:
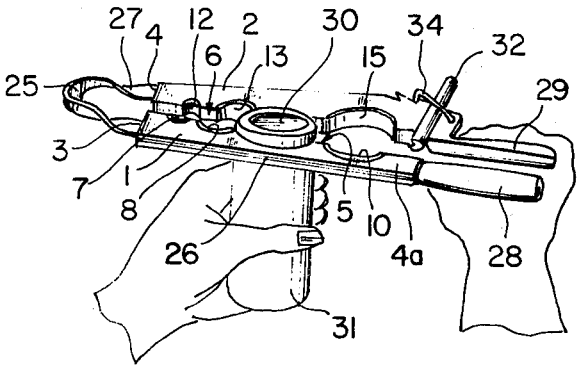
FIG. 1 is a perspective view of an embodiment of the jar and bottle opener of the invention in use.
Figure 2:
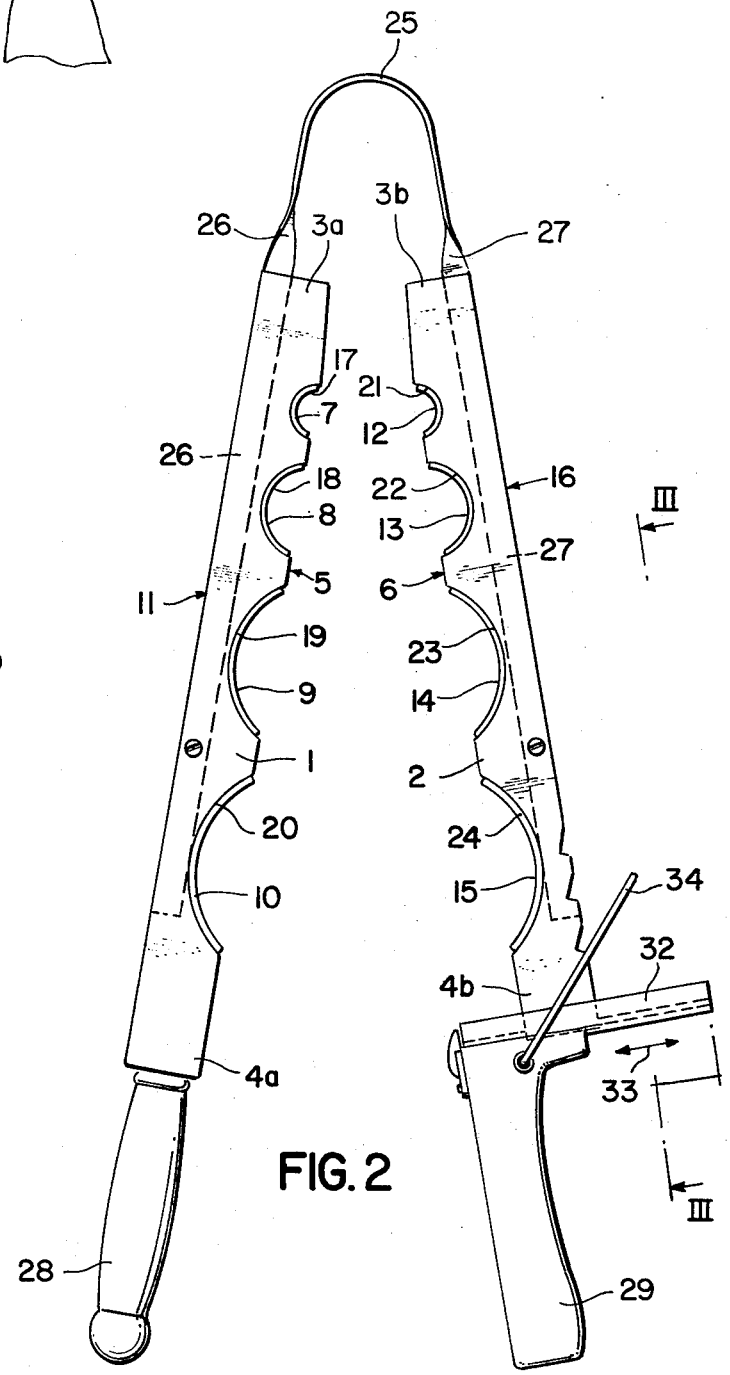
FIG. 2 is a view, on an enlarged scale, of the embodiment of FIG. 1.

The jar and bottle opener of the invention comprises first and second symmetrical elongated gripping members 1 and 2 (FIGS. 1 and 2). The gripping members 1 and 2 have spaced opposite first and second ends 3*a* and 4*a*, and 3*b* and 4*b*, respectively (FIGS. 1 and 2). The gripping members 1 and 2 have a first length-extending edge 5 and 6, respectively (FIGS. 1 and 2).

The first edge 5 of the gripping member 1 has a plurality of spaced substantially partially circular notches 7, 8, 9 and 10 formed therein, as shown in FIGS. 1 and 2, and an opposite second length-extending edge 11 (FIG. 2). The second gripping member 2 has a plurality of spaced substantially partially circular notches 12, 13, 14 and 15 formed therein, as shown in FIGS. 1 and 2, and an opposite second length-extending edge 16 (FIG. 2). The notches 7 and 12 have the same diameter. The notches 8 and 13 have the same diameter. The notches 9 and 14 have the same diameter. The notches 10 and 15 have the same diameter. The diameters of the notches 7 and 12, 8 and 13, 9 and 14, and 10 and 15 vary from a minimum in the area of the first ends 3*a* and 3*b* to a maximum in the area of the second ends 4*a* and 4*b*. Thus, the diameters of the aforedescribed notches increase from the notches 7 and 12 to the notches 8 and 13, from the notches 8 and 13 to the notches 9 and 14 and from the notches 9 and 14 to the notches 10 and 15.

The notches 7 to 10 and 12 to 15 formed in the first and second gripping members are preferably lined with rubber, as shown in FIG. 2. Thus, the notches 7 to 10 are lined with rubber 17, 18, 19 and 20, respectively, and the notches 12 to 15 are lined with rubber 21, 22, 23 and 24, respectively.

Figure 3:
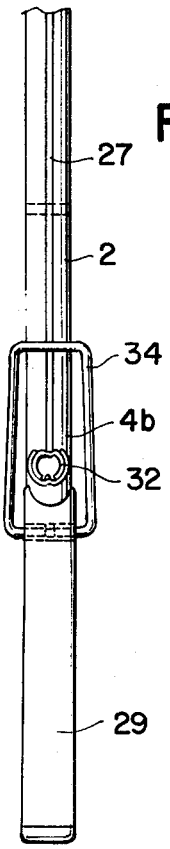
FIG. 3 is a view, taken along the lines III—III, of FIG. 2.

A joining member 25 (FIGS. 1 and 2) consists of substantially resilient material such as, for example, spring steel bent in a generally V-shape. The joining member 25 has a pair of elongated arms 26 and 27, respectively, angularly disposed relative to each other, as shown in FIGS. 1 and 2. The arms 26 and 27 of the joining member 25 are affixed to the second edges 11 and 16, respectively, of the gripping members 1 and 2 in a manner whereby the first edges 5 and 6, respectively, of said gripping members are angularly disposed in facing relation relative to each other with the minimum diameter notches 7 and 12 thereof closer to each other than the maximum diameter notches 10 and 15 thereof, as shown in FIGS. 1 and 2. As shown in FIGS. 1 to 3, the arms 26 and 27 of the joining member 25 are preferably snugly accommodated in slots formed along the lengths of the gripping members 1 and 2 and opening along their second edges 11 and 16, respectively.

Handles 28 and 29 extend from the second ends 4*a* and 4*b* of the first and second gripping members 1 and 2, respectively, to facilitate urging said second ends toward each other to grasp a lid 30 (FIG. 1) of a container 31 (FIG. 1) between corresponding notches of said gripping members. The handle 28 is fixedly mounted on the second end 4*a* of the first gripping member 1. The handle 29 is movably adjustably mounted on the second end 4*b* of the second gripping member 2. This is accomplished by a handle mounting device 32 mounted on the second gripping member 2 at the second end 4*b* thereof. The mounting device 32 adjustably mounts the handle 29 for movement in directions transverse to the length of the gripping member 2, as indicated by arrows 33 in FIG. 2. More particularly, the handle 29 is slidably mounted for movement along the handle mounting device 32, which constitutes a member extending perpendicularly to the second gripping member 2 and having guide means thereon for guiding the handle 29 in the directions of the arrows 33. The handle 29 may thus be moved closer to, or farther from, the handle 28, as desired, and secured in position via a securing member 34, thereby enabling the jar and bottle opener of the invention to be utilized with a very wide range of lids of different diameters.

While the invention has been described by means of a specific example and in a specific embodiment, I do not wish to be limited thereto, for obvious modifications will occur to those skilled in the art without departing from the spirit and scope of the invention.

I claim:

1. A jar and bottle opener, comprising first and second symmetrical elongated gripping members each having spaced opposite first and second ends, each of said gripping members having a first length-extending edge with a plurality of spaced substantially partially circular notches formed therein and an opposite second length-extending edge, the diameters of the notches varying from a minimum in the area of the first end to a maximum in the area of the second end;

a joining member of substantially resilient material bent in a generally V-shape and having a pair of elongated arms angularly disposed relative to each other, each of the arms being affixed to the second edge of a corresponding one of the gripping members in a manner whereby the first edges of said gripping members are angularly disposed in facing relation relative to each other with the minimum diameter notches thereof closer to each other than the maximum diameter notches thereof;

handles extending from the second ends of the gripping members to facilitate urging said second ends toward each other to grasp a lid of a container between corresponding notches of said gripping members; and handle mounting means mounted on the second gripping member at the second end thereof for adjustably mounting the handle thereof for movement in directions transverse to the length of said gripping member.

* * * * *